United States Patent [19]

Bakerman

[11] 4,363,502

[45] Dec. 14, 1982

[54] ILLUMINATIVE SKATE WHEEL

[76] Inventor: David Bakerman, 1530 Palisade Ave., Fort Lee, N.J. 07024

[21] Appl. No.: 205,381

[22] Filed: Nov. 10, 1980

[51] Int. Cl.[3] ..... A63C 17/26

[52] U.S. Cl. ..... 280/816; 301/5.7; 362/103

[58] Field of Search ..... 280/809, 816, 11.19, 280/11.1 R; 301/5.3, 5.7; 362/103, 205, 35; 46/202

[56] References Cited

U.S. PATENT DOCUMENTS

| | | | |
|---|---|---|---|
| 2,392,634 | 1/1946 | Bierman | 301/5.3 |
| 2,931,012 | 3/1960 | Kosach | 280/809 |
| 3,014,125 | 12/1961 | Draudt | 362/205 |
| 3,789,208 | 1/1974 | Lewis | 362/35 |
| 3,946,505 | 3/1976 | Dana | 362/103 |
| 4,045,046 | 8/1977 | Taylor et al. | 301/5.7 |
| 4,054,335 | 10/1977 | Timmer | 301/5.3 |
| 4,298,910 | 11/1981 | Price | 301/5.7 |

*Primary Examiner*—David M. Mitchell

*Attorney, Agent, or Firm*—Howard F. Mandelbaum

[57] ABSTRACT

A skate has a wheel rotatably mounted on an axle with a light emitting element mounted on the wheel for making the wheel illuminative when an electrical potential is applied to the light emitting element. The electrical potential can be supplied by a battery installed within the wheel through a switch which can be actuated by rotating a cap movably mounted on the hub of the wheel or contacts actuated by centrifugal force upon rotation of the wheel. The rotor and stator of an electrical generator can be mounted on the axle and wheel to generate the electrical potential in an embodiment which does not require a battery.

3 Claims, 6 Drawing Figures

FIG. 1
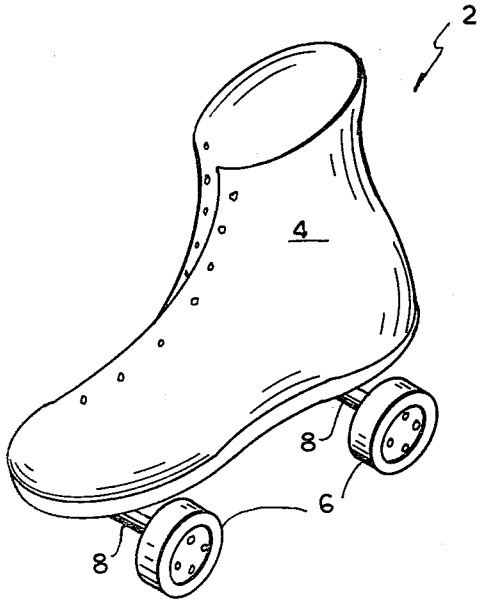
FIG. 4
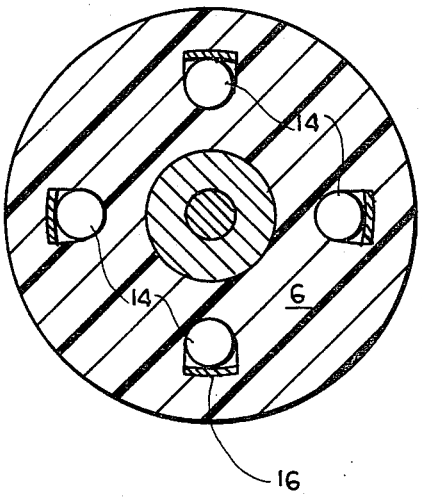
FIG. 3
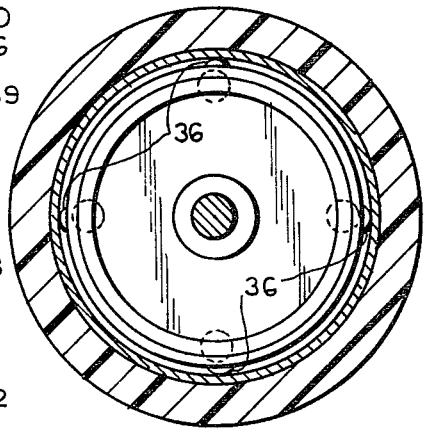
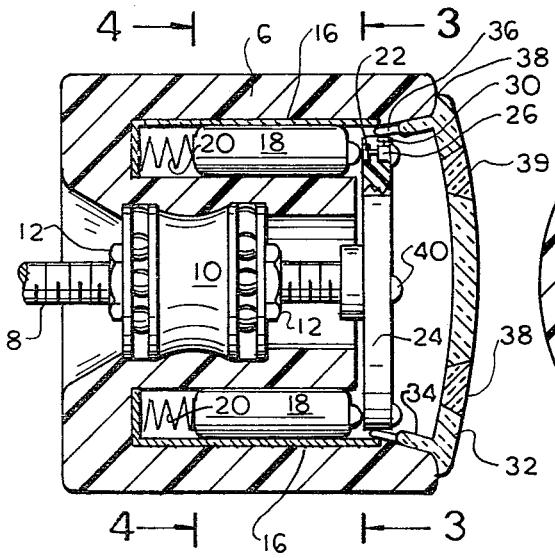
FIG. 2

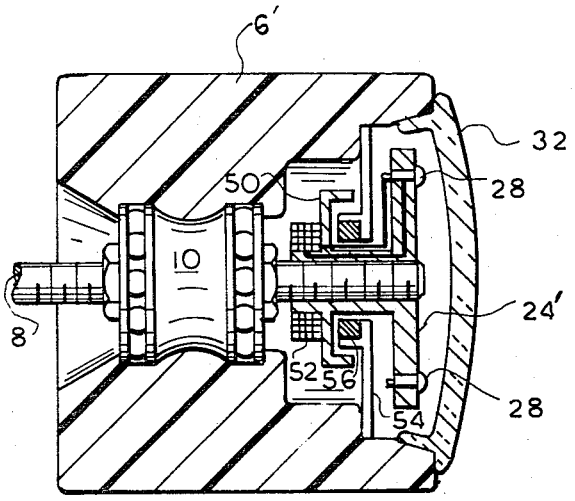
FIG. 6
FIG. 5
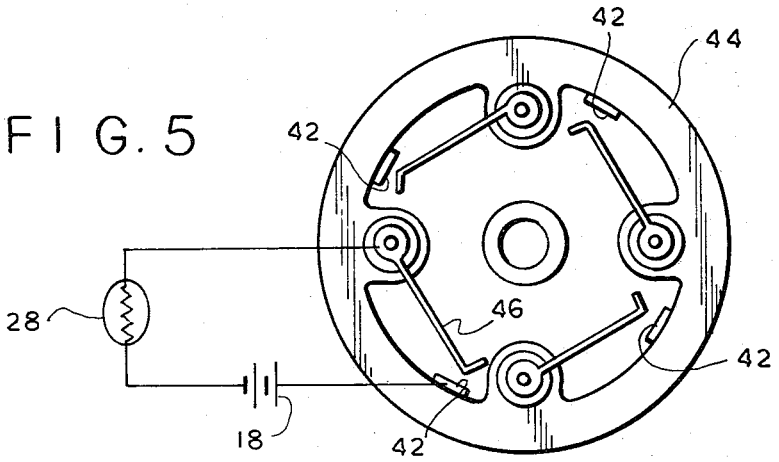

ILLUMINATIVE SKATE WHEEL

BACKGROUND OF THE INVENTION

The present invention relates to skates commonly used for sport or amusement and, in particular, to such skates which are used during exhibitions such as "roller-disco" dancing. More specifically, the invention relates to a skate wheel which can be rendered illuminative during use.

It is known in the art to provide various objects with light emitting elements and sources of electrical potential to render them illuminative to enhance their visibility under poor lighting conditions or to make their appearance aesthetically pleasing. Examples of such prior art devices include battery powered "disco" shoes wherein the bottom portion of the extended heel of the shoe is capable of emitting light when contact is made with the floor or ground. There are battery powered lighted indicator belts which are worn by operators of open vehicles such as bicycles and motorcycles to render the operator visible to traffic. There also exists, in the prior art, an illuminated aerial top (yo-yo) wherein the centrifugal forces resulting from the spinning of the top cause contacts to complete a circuit with a battery and lightbulb within the top thereby causing the top to become illuminative.

There are also known to the art, rollerskate wheels which are decorated to be ornamental in appearance and reflect light with various intensities and/or colors. However, the aesthetic appearance of such rollerskate wheels is dependent upon light provided within the ambient environment or from external sources and does not provide a contrast with the surroundings of sufficient magnitude to provide the pleasing aesthetic affect apparent in a self-illuminating skate wheel.

SUMMARY OF THE INVENTION

In order to provide the aesthetic effect lacking in prior art skate wheels, the present invention teaches the construction of a skate having an axle and a wheel rotatably mounted on the axle with the assembly formed by the wheel and axle having a light emitting element, a source of electrical potential, and means for applying the electrical potential to the light emitting element to render the skate wheel illuminative. In one embodiment of the invention the wheel is provided with a translucent cap on its hub, the cap having a conductive contact which completes a circuit between a battery housed within the wheel and a light emitting element when the cap is rotated to a predetermined position. In a second embodiment of the invention, normally separated contacts are disposed within the wheel for engagement upon application of centrifugal force resulting from rotation of the wheel about the axle. In still a third embodiment of the invention, the rotor and stator of an electrical generator are mounted on the axle and wheel for generating an electrical potential, without need for a battery, to energize the light emitting element upon rotation of the wheel about the axle.

It is, therefore, an object of the invention to provide a skate with a wheel which can be manually rendered illuminative by the user.

Another object of the invention is to provide a skate with a wheel which is rendered illuminative during rotation of the wheel.

Still another object of the invention is to provide a skate with a wheel which is rendered illuminative only when the angular velocity of rotation of the wheels exceeds a predetermined magnitude.

A further object of the invention is to provide a skate with a wheel which is rendered illuminative with a magnitude of intensity of illumination which varies with the angular velocity of wheel rotation.

Still a further object of the invention is to provide a skate wheel which can be rendered illuminative without need for batteries or other sources of electrical potential which require periodic replacement.

An additional object of the invention is to provide a skate with a wheel which can be rendered illuminative by means of a source of electrical potential and a light emitting element mounted within the wheel which are not normally visible but to which access can readily be obtained for maintenance purposes.

Other and further objects of the invention will be apparent from the following drawings and description of three preferred embodiments of the invention in which like reference numerals are used to indicate like parts in the various views.

DESCRIPTION OF THE DRAWINGS

FIG. 1 is a perspective view of a skate in accordance with the invention.

FIG. 2 is a sectional view of the wheel and axle assembly of the skate shown in FIG. 1.

FIG. 3 is a sectional view taken through line 3—3 of FIG. 2.

FIG. 4 is a sectional view taken through line 4—4 of FIG. 2.

FIG. 5 is a sectional view of a second embodiment of a skate wheel and axle assembly illustrating a second embodiment of the invention, and FIG. 6 is a sectional view of a skate wheel and axle assembly illustrating a third preferred embodiment of the invention.

DESCRIPTION OF THE PREFERRED EMBODIMENT

Referring now to FIG. 1 of the drawings there is shown a skate 2 having a shoe 4 mounted thereon and including wheels 6 rotatably mounted on respective axles 8.

In a first embodiment of the invention, illustrated in FIGS. 2, 3, and 4, the wheel 6 is mounted on the axle 8 by means of a ball bearing assembly, 10 which is held axially in place by nuts 12 threaded onto the axle 8 in a conventional manner.

Bored into the wheel 6 there are elongated cavities 14 having axes parallel to the axis of the wheel 6 and axle 8. Each of the cavities 14 is fitted with a conductive contact member 16 which has an L-shaped cross-section in the view of FIG. 2. The cavities 14 are of suitable cross-section and length to receive a cylindrical battery 18 the negative terminal end of which is maintained in contact with the corresponding contact member 16 by a conductive coil spring 20.

The positive terminal end of the battery 18 is urged by the force of the compressed spring 20 into contact with a terminal 22 mounted on a fiber disk shaped insulating member 24 which is in turn mounted on the wheel 6 for rotation therewith. The fiber disk 24 includes a standard threaded lamp socket 26 for receiving a light emitting element such as a miniature flashlight lamp 28. The center terminal of the lamp 28 is urged into contact with the terminal 22 when the lamp 28 is threaded into the socket 26. The circumference of the base of the lamp 28 is electrically connected to a contact 30 which is normally spaced from the contact 16 thereby interrupting the circuit between the negative terminal of the battery 8 and the outer terminal portion of the lamp 28.

A convex cap 32 formed from a translucent plastic or other material having similar properties has an integral inwardly projecting circular ridge 34 which can be force fitted into a recess in the hub of the wheel 6 as shown in FIG. 2. Spaced along the ridge 34 and projecting inwardly thereof are metallic contacts 36 which are angularly displaced from one another by angular distance equal to the angular displacements between the contacts 26 and between the contacts 16 (i.e. ninety degrees in the illustrated embodiment of FIGS. 1-4). By rotating the cap 32 relative to the wheel 6, the contacts 36 can be forced into the gap between the contacts 26 and 16, thereby bridging the gap and completing a circuit between the negative end terminal of the battery 18 and the circumferential contact of the lamp 28 to energize the lamp and cause it to illuminate the wheel 6 and, in particular, the translucent cap 32. As a result of the equal angular displacements among the lamps 28 and the gaps between the contacts 16 and 26, all four of the lamps on the wheel are energized and extinguished simultaneously depending upon the angular position to which the cap 32 is rotated relative to the wheel 6. The weight of the wearer of the skates is normally sufficient to prevent rotation of the wheels 6 when the caps 32 are being rotated by the hand of the user.

In order to permit access to the wheel for replacing a burned out lamp, the cap 32 can be withdrawn by wedging a fingernail between the cap 32 and wheel 6 at their interface 38. The cap 32 may be provided with projections or recesses to provide a grasping surface to fcilitate rotation of the cap 32 relative to the wheel 6 for energizing and extinguishing the lamps 28. Should it be necessary to replace an exhausted battery, the fiber disk 24 can be removed by unthreading a retaining nut 40 thereby providing access to the cavities 14 in which the batteries 18 are stored.

The translucent cap 32 may also have areas of various colors as well as areas which are less translucent than others or areas which are opaque. As used herein, the term "translucent" encompasses transparent materials which allow viewing therethrough as well as materials which transmit light while difusing it. The cap 32 may also have regions 38 formed of material having an index of refraction different than the index of refraction of the remainder of the material from which the cap 32 is formed. Areas 39 may also be ground to act as condensors or lenses to obtain various asesthetic visual effects.

Referring now to FIG. 5 of the drawings, there is shown a section of a skate wheel assembly constructed in accordance with a second preferred embodiment of the invention. The embodiment of FIG. 5 is virtually identical to the embodiment of FIGS. 2, 3 and 4 with the exception that the contacts 16, 26 and 36 are omitted. Instead the positive terminal ends of the batteries 18 are connected to contacts 42 which are fixedly mounted to the interior circumference of a hollow circular ring 44 made of a nonconductive material such as plastic or a nonconductive fiber material. The negative terminal end of the battery 18 is connected to one of the terminal surfaces of the lamp 28. The opposite terminal surface of the lamp 28 is connected to the base of an elongated contact arm 46. The contact arm 46 is preferably made of a resilient conductive metal, e.g. copper, and its free end is movable in a plane parallel to the plane of the ring 44.

The contact arm 46 can have its base fixedly connected to the ring 44 with the free end of the contact arm 46 normally out of engagement with the corresponding contact 42. Upon rotation of the wheel 6, and hence the ring 44, the free end of each of the contact arms 46 is driven by centrifugal force toward and into engagement with its corresponding contact 42 to complete a circuit between the battery 18 and lamp 28. Alternatively, the contact arms 46 can be pivotally mounted at their bases on the ring 44 with a spring interposed between the base of the contact arm 46 and the surface of the ring 44 with the spring normally urging the contact arm 46 toward a position out of engagement with its corresponding contact 42. The spring can be a leaf spring or a coil spring. Upon rotation of the wheel 6 above a predetermined magnitude of angular velocity, the free end of the contact arm 46 is driven toward the contact 42 to complete the circuit between the battery 18 and lamp 28. The battery 18 and lamp 28 are shown schematically in FIG. 5 and for only one set of contacts 42 and 46. It is to be appreciated that in the embodiment of the invention illustrated in FIG. 5, a battery 18 and lamp 28 would be provided for each set of corresponding contacts 42 and 46.

Referring now to FIGS. 6 of the drawings there is shown a third preferred embodiment of the invention which obviates the need for batteries or any other exhaustable source of electrical potential. In the embodiment of FIG. 6, the kinetic energy imparted to the skate wheel for rotating it during skating is used to drive an electrical generator to develop an electrical potential across the lamps 28.

A wheel 6′ is rotatably mounted on the axle 8 by means of the bearing 10 as previously described with reference to FIG. 2. Fixedly mounted on the axle 8 is the stator 50 of the electrical generator. A coil winding 52 is wound about the stator and is connected across the terminals of each of the lamps 28 which are supported in a plastic or fiber disk 24′ which is also fixedly mounted on the axle 8. A rotor 54 which includes a cylidrical magnet 56 is fixedly mounted on the wheel 6′ with the axis of the magnet 56 coincident with the axis of the axle 8. Rotation of the wheel 6′ causes the rotor 54 with magnet 56 mounted upon it to rotate with its magnetic field intersecting the adjacent members of the stator 50 in the manner of operation of a conventional electrical generator. The resulting electromotive force induced in the winding 52 provides and electrical potential to the filaments of the lamps 28. The higher the rate of speed of rotation of the wheel 6′, the greater is the electrical potential applied across the filaments of the lamps 28, and the greater is the magnitude of luminescence of the lamps 28. Hence, the intensity of light emitted by the lamps 28 varies directly with the speed of rotation of the wheel 6′.

As used herein, the word "skate" refers to a device having a platform adapted to support the weight of a person or object and wheels for permitting the platform to ride over a surface such as a floor or a roadway. Although the three preferred embodiments of the invention described herein relate to roller skates adapted to be worn on the feet of a user, the inventon is equally applicable to other types of skates, e.g., skateboards. Alterations or modifications may be made of one or more of the disclosed embodiments to provide still other embodiments within the spirit and scope of the invention wich is defined in the following claims.

What is claimed is:

1. In a skate having an axle, and a wheel rotatably mounted on said axle, the improvement which comprises a pair of terminals mounted within said wheel and adapted to have an electrical potential applied thereacross, and light emitting means operatively connectable to said terminals, mounted on said wheel and responsive to application of said electrical potential thereto for emitting light, a source of electrical potential removably mounted within said wheel, contact means connected between said source of potential and at least one of said terminals, said contact means being operative between an open state in which application of said electrical potential to said one of said terminals is interrupted for extinguishing said light emitting means and a closed state in which said potential is applied to said one of said terminals or illuminating said light emitting means, and a translucent cap member mounted over the hub of said wheel and being illuminated by said light emitting means when said potential is applied to said terminal, said cap member being selectively engageable with said contact means and movably mounted on said wheel for movement between a first position in which said contact means is caused to be in said open state and a second position in which said contact means is caused to be in said closed state.

2. Apparatus according to claim 1 wherein at least part of said contact means is mounted on said cap member.

3. Apparatus according to claim 2 wherein said cap member is removably mounted on said wheel for providing access to at least one of said light emitting means and said source of electrical potential.

* * * * *